US008745780B2

(12) United States Patent
Su

(10) Patent No.: US 8,745,780 B2
(45) Date of Patent: Jun. 10, 2014

(54) BABY CRIB

(71) Applicant: Yu-Ya Su, Taipei (TW)

(72) Inventor: Yu-Ya Su, Taipei (TW)

(73) Assignee: Wonderland Nurserygoods Company Limited, Hong Kong (HK)

( * ) Notice: Subject to any disclaimer, the term of this patent is extended or adjusted under 35 U.S.C. 154(b) by 0 days.

(21) Appl. No.: 13/759,619

(22) Filed: Feb. 5, 2013

(65) Prior Publication Data

US 2013/0145547 A1 Jun. 13, 2013

Related U.S. Application Data

(62) Division of application No. 13/151,545, filed on Jun. 2, 2011.

(60) Provisional application No. 61/355,201, filed on Jun. 16, 2010.

(51) Int. Cl.
*A47D 7/00* (2006.01)

(52) U.S. Cl.
USPC ..... 5/93.1; 5/93.2; 5/95; 312/301; 312/302; 312/310; 312/313; 312/322

(58) Field of Classification Search
USPC ..... 5/93.1, 93.2, 95, 100; 312/301, 302, 312/309–311, 313, 315, 322, 323
See application file for complete search history.

(56) References Cited

U.S. PATENT DOCUMENTS

| | | | | | |
|---|---|---|---|---|---|
| 793,168 | A * | 6/1905 | Abrams | 5/81.1 HS |
| RE13,719 | E * | 4/1914 | Taylor | 5/99.1 |
| 1,391,566 | A * | 9/1921 | Musselman | 5/2.1 |
| 1,741,014 | A * | 12/1929 | Debelack | 280/31 |
| 2,688,997 | A * | 9/1954 | Miller | 297/129 |
| 3,403,412 | A * | 10/1968 | Gottfried et al. | 5/100 |
| 3,851,981 | A * | 12/1974 | Corsi et al. | 403/237 |
| 3,921,233 | A * | 11/1975 | Mann | 5/97 |
| 4,021,867 | A * | 5/1977 | Maxwell, Jr. | 5/106 |
| 4,709,972 | A * | 12/1987 | LaBudde et al. | 312/208.3 |
| 4,891,852 | A * | 1/1990 | Lopez, Jr. | 5/105 |
| 5,970,539 | A * | 10/1999 | McDermott et al. | 5/98.1 |
| 6,318,824 | B1 * | 11/2001 | LaGrotta et al. | 312/322 |
| 6,339,855 | B1 * | 1/2002 | Socha et al. | 5/93.1 |
| 6,457,196 | B1 * | 10/2002 | Dykes et al. | 5/655 |
| 6,626,686 | B1 * | 9/2003 | D'Souza et al. | 439/131 |
| 6,938,286 | B1 | 9/2005 | Smith | |
| 2004/0068797 | A1 * | 4/2004 | Smith et al. | 5/617 |
| 2008/0189861 | A1 * | 8/2008 | Smith et al. | 5/611 |

FOREIGN PATENT DOCUMENTS

| | | |
|---|---|---|
| CN | 2274453 Y | 2/1998 |

* cited by examiner

*Primary Examiner* — Robert G Santos
*Assistant Examiner* — Ifeolu Adeboyejo
(74) *Attorney, Agent, or Firm* — David I. Roche; Baker & McKenzie LLP

(57) ABSTRACT

A baby crib includes a support frame having a lower portion and an upper portion, and a bassinet connected with the upper portion of the support frame. The bassinet includes an enclosure substantially surrounding an inner space of the bassinet adapted to receive a baby, the enclosure being upwardly opened and having a sidewall provided with a side opening communicating with the inner space, and a movable board disposed at a bottom of the bassinet and adapted to support the weight of the baby placed thereon. The board is operable to slide through the side opening between a first position where the board and the baby placed thereon lie inside the inner space, and a second position where the board extends outward through the side opening so that the board and the baby placed thereon lie substantially outside the inner space.

15 Claims, 13 Drawing Sheets

BABY CRIB

CROSS-REFERENCE TO RELATED APPLICATION

This patent application is a divisional of U.S. patent application Ser. No. 13/151,545 filed on Jun. 2, 2011.

BACKGROUND

1. Field of the Invention

The present invention generally relates to baby cribs, and more particularly to baby cribs that may also be conveniently used as bedside cribs.

2. Description of the Related Art

Baby cribs available on the market include movable baby cribs and fixed baby cribs. Movable baby cribs can be conveniently displaced to any desired positions, and are not limited in positions of use. On the other hand, fixed baby cribs have to be used at fixed positions, usually near a sleeping bed so that the caregiver can conveniently access to the baby crib. The fixed baby crib usually has an enclosure that may be opened to facilitate access to the child placed in the baby crib. Each of the fixed and movable baby crib has specific advantages and limitations inherent to their respective constructions.

Therefore, there may be a need for an improved baby crib that can have the advantages of the fixed and movable baby cribs, and is versatile in use.

SUMMARY

The present application describes a baby crib that can be used as bedside crib to allow a caregiver to sleep with the child on different beds, and yet provide care in a convenient manner. According to one embodiment, the baby crib includes a support frame having a lower portion and an upper portion, and a bassinet connected with the upper portion of the support frame. The bassinet includes an enclosure substantially surrounding an inner space of the bassinet adapted to receive a baby, the enclosure being upwardly opened and having a sidewall provided with a side opening communicating with the inner space, and a movable board disposed at a bottom of the bassinet and adapted to support the weight of the baby placed thereon. The board is operable to slide through the side opening between a first position where the board and the baby placed thereon lie inside the inner space, and a second position where the board extends outward through the side opening so that the board and the baby placed thereon lie substantially outside the inner space.

DETAILED DESCRIPTION OF THE EMBODIMENTS

Figure 1:
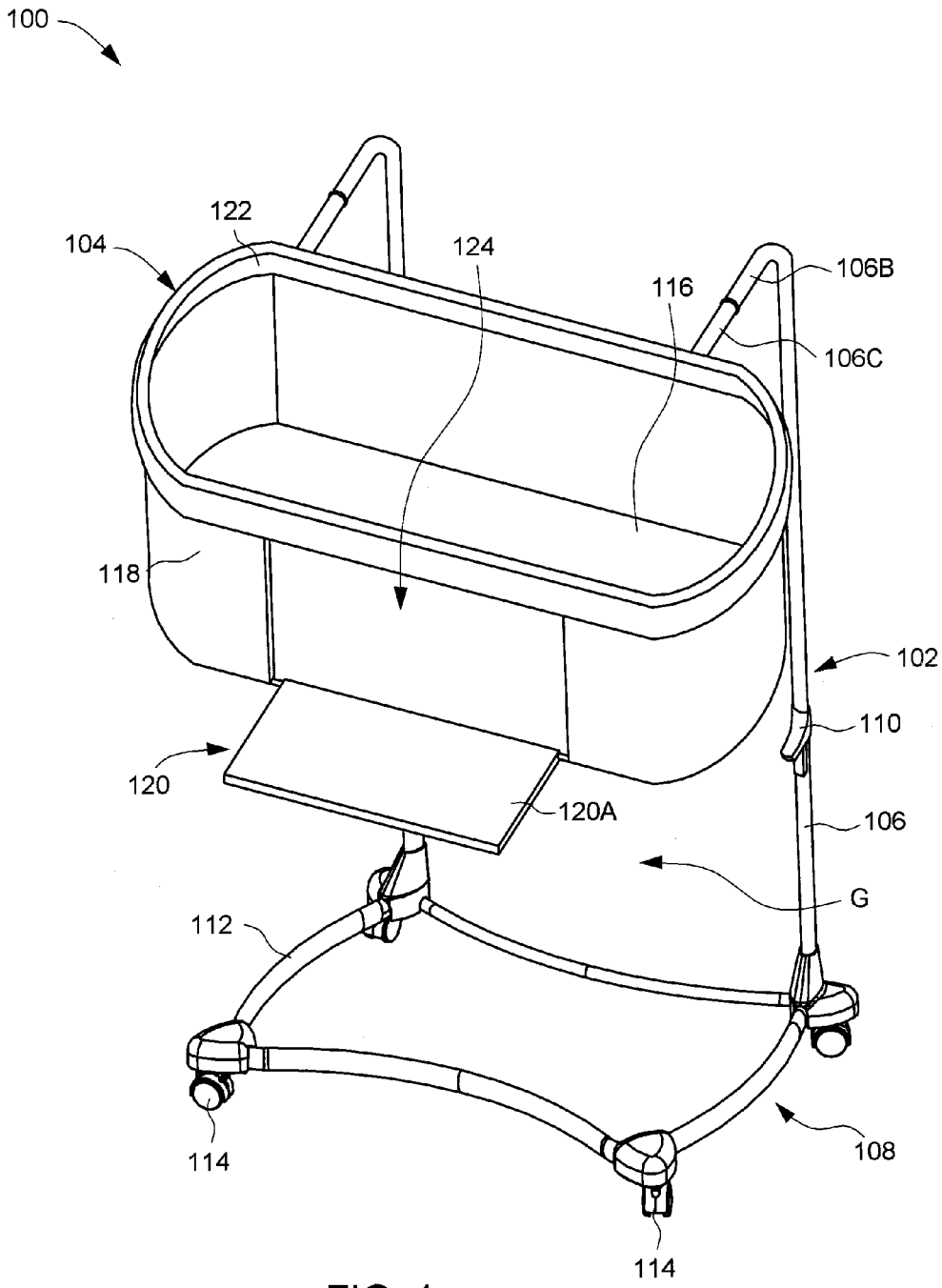
FIG. 1 is a perspective view illustrating an embodiment of a baby crib.
Figure 2:
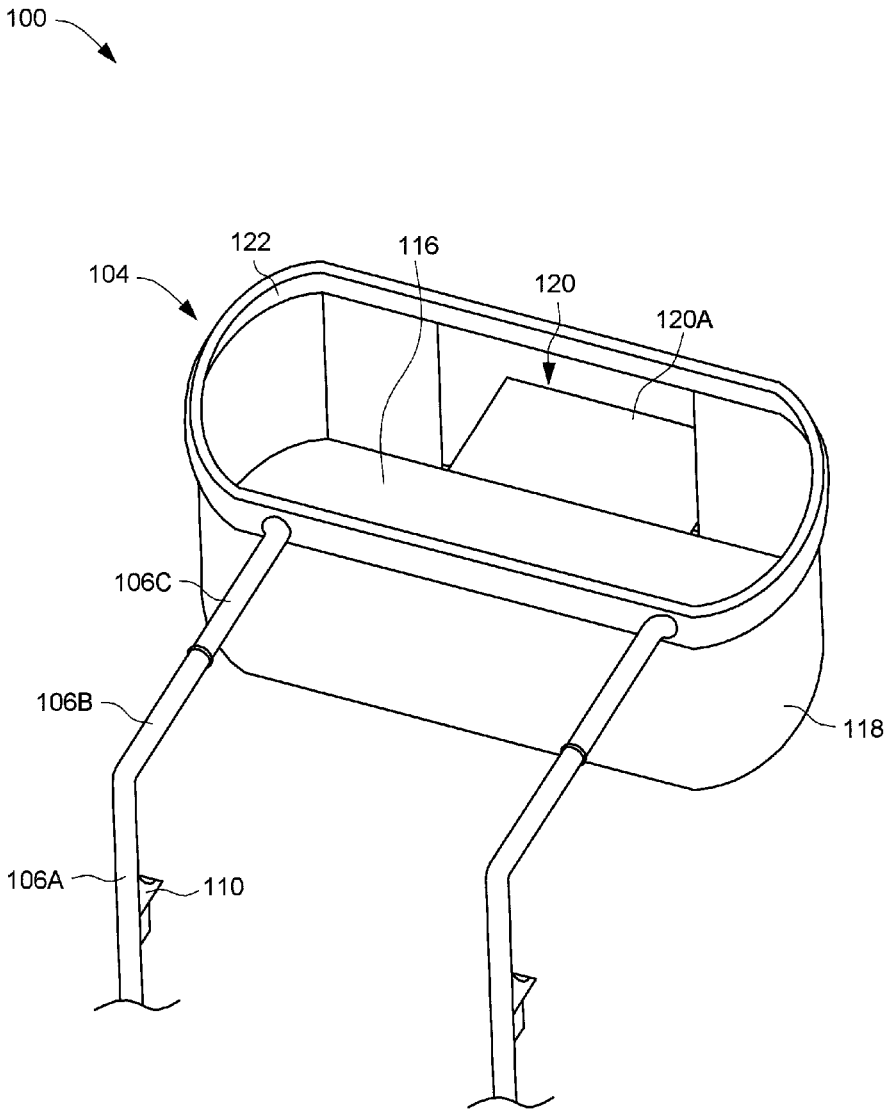
FIG. 2 is a schematic view illustrating a rear portion of the baby crib shown in FIG. 1.

FIG. 1 is a perspective view illustrating an embodiment of a baby crib 100, and FIG. 2 is a schematic view illustrating a rear portion of the baby crib 100. The baby crib 100 can include a support frame 102 and a bassinet 104. The support frame 102 can be constructed so as to hold the bassinet 104 above the ground. In one embodiment, the support frame 102 can include two parallel support tube assemblies 106, and a base 108 connected with the support tube assemblies 106. Each of the support tube assemblies 106 can include an upright segment 106A, and an arm 106B connected with the upright segment 106A. The arms 106B can bend to a same side from the upper end of the upright segments 106A, and have respective distal ends securely connected with the bassinet 104. In one embodiment, each of the arms 106B can include a telescopic portion 106C adapted to retract and deploy outward to movably adjust the bassinet 104 in a horizontal plane toward or away from the upright segments 106A. Each of the upright segments 106A can also include a latch 110 operable to lock for preventing movements of the telescopic portion 106C, and unlock for permitting adjustment of the telescopic portion 106C.

The base 108 can be connected with the lower ends of the upright segments 106A, and can be located at a same side as the bassinet 104 relative to the upright segments 106A to provide stable support. The bassinet 104 is vertically spaced apart from the base 108 via a gap G, i.e., the gap G is delimited upwardly by the bassinet 104 and downwardly by the base 108. In addition, a side of the gap G is at least partially delimited by the upright segments 106A, whereas an opposite side thereof is opened without any obstructing elements.

The base 108 can include a plurality of tubular elements 112 and wheels 114 assembled in a horizontal plane. The tubular elements 112 can be assembled with one another to form a generally rectangular base 108. The wheels 114 can be respectively provided at the four corners of the base 108. The lower ends of the two upright segments 106A can be respectively connected with two corners of the base 108.

In one embodiment, the bassinet 104 can include a bottom board 116 on which a child can be laid down, a surrounding enclosure 118, a cover element 120, and a hand rest rail 122. The hand rest rail 122 can be provided along the top of the enclosure 118. A lower end of the enclosure 118 can be connected with a peripheral region of the bottom board 116 so as to define at least partially an inner space of the bassinet 104. The bassinet 104 is upwardly opened, such that a caregiver can place a baby in the bassinet 104 from the upper side. A sidewall of the enclosure 118 can also include a side opening 124. In one embodiment, the side opening 124 can be formed at a side of the enclosure 118 that is opposite to the side of the support tube assemblies 106 (i.e., corresponding to a front of the bassinet 104). In one embodiment, the cover element 120 can be exemplary formed as a door 120A made from a rigid material that is pivotally connected with the bottom board 116. The door 120A can be operable to move relative to the enclosure 118 to cover and uncover the side opening 124.

Figure 3:
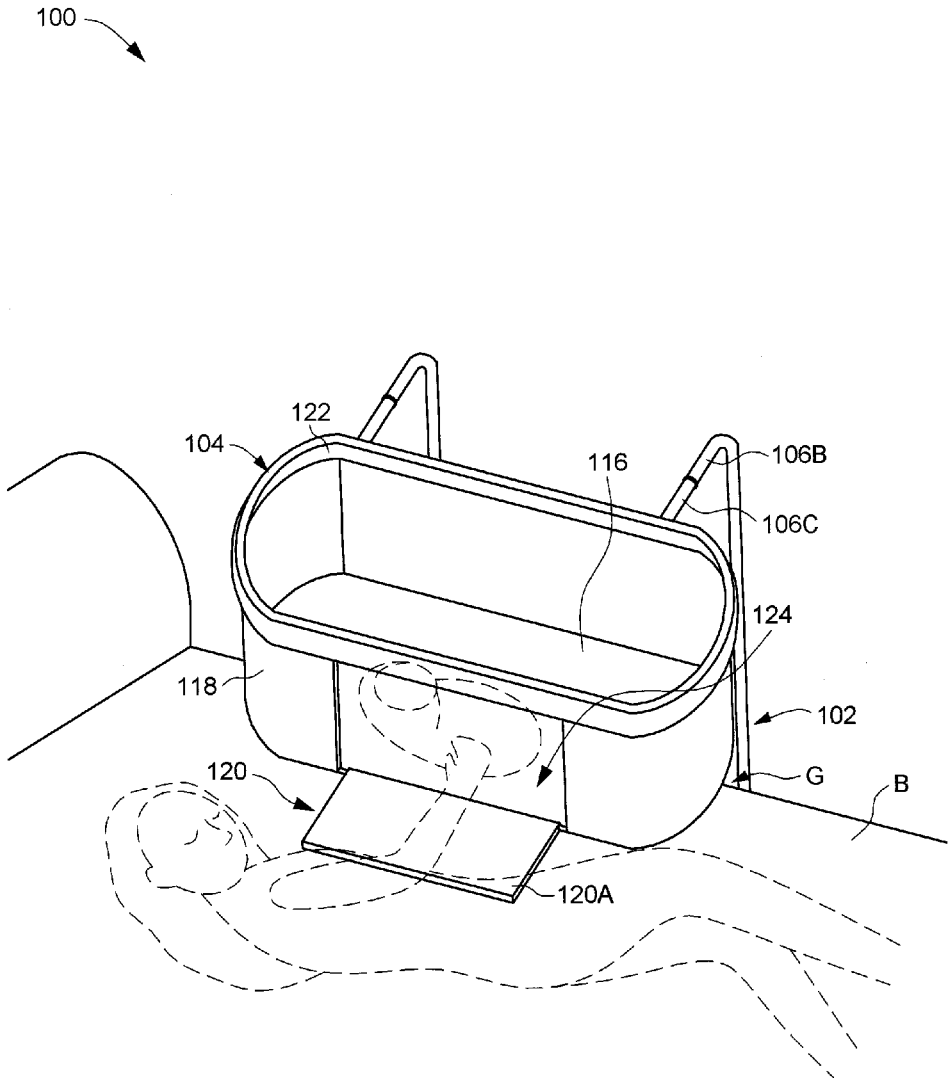
FIG. 3 is a schematic view illustrating the baby crib in a configuration of use.

FIG. 3 is a schematic view illustrating the baby crib 100 in a configuration of use. The baby crib 100 can be used as a convenient bedside crib. The support frame 102 can be pushed to displace via the wheels 114 to lie adjacent to a side of an adult sleeping bed B, such that the base 108 is located below the bed B and the peripheral edge portion of the bed B is placed in the gap G between the bassinet 104 and the base 108. By operating the latches 110 on the upright segments 106A, the extension of the bassinet 104 over the sleeping bed B can also be adjusted to a desired height. While the cover element 120 is opened, the caregiver's hands can be passed through the side opening 124 into the inner space of the bassinet 104. Accordingly, while being on the sleeping bed B, the caregiver can provide care and conveniently place the baby into the bassinet 104 via the side opening 124 without efforts or excessive movements that may disturb the child. Moreover, while the caregiver is laid down on the sleeping bed B, the cover element 120 can also be opened so that the baby lying in the bassinet 104 can be visible through the side opening 124. When the baby is sleeping, the cover element 120 can be operable to close the side opening 124 to reduce disturbance to the baby. Accordingly, the baby crib 100 can be used as a bedside crib to allow a caregiver to sleep with the child on different beds, and yet provide care in a convenient manner.

Figure 4:
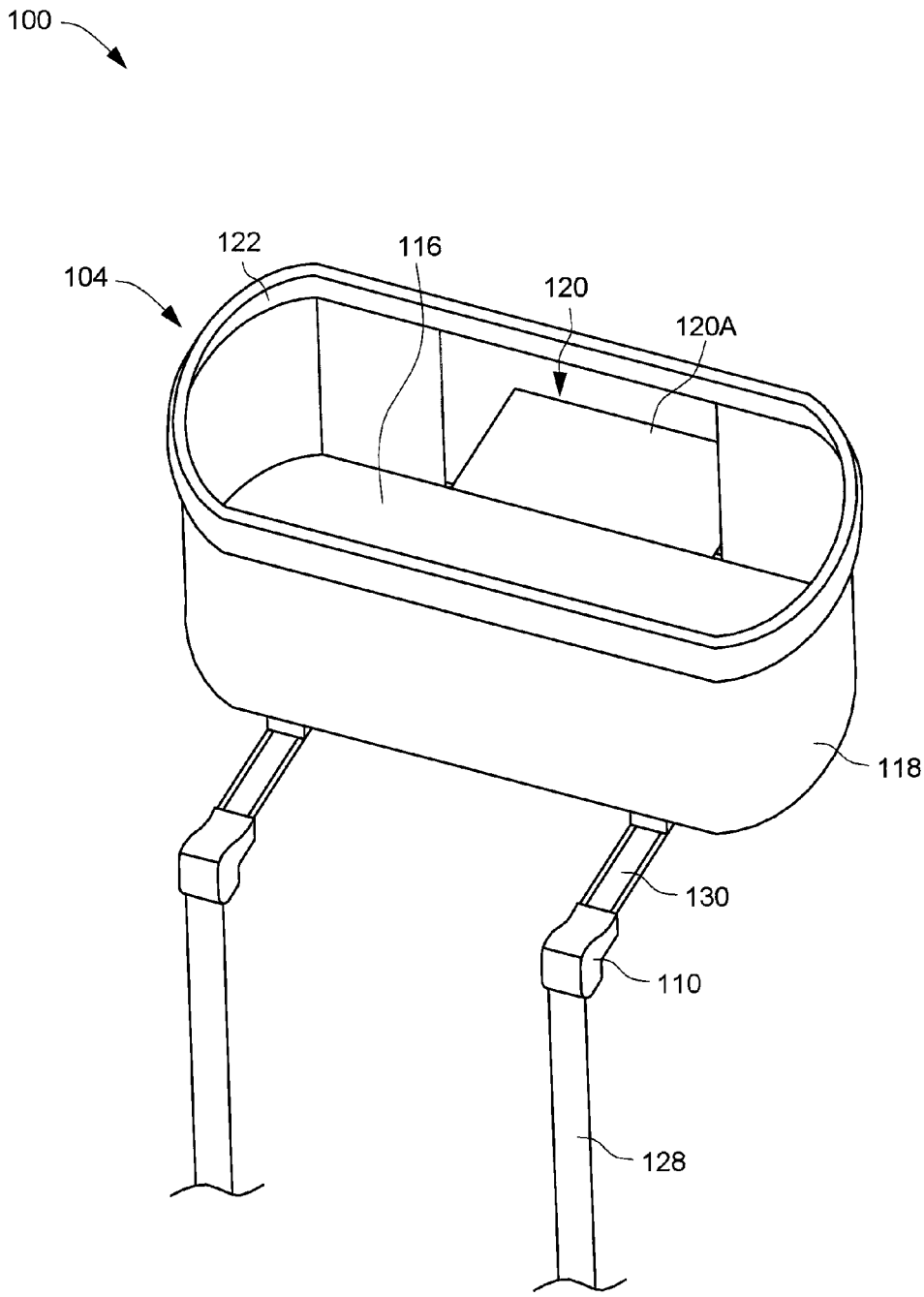
FIG. 4 is a schematic view illustrating a rear portion of the baby crib according to a variant embodiment.

FIG. 4 is a schematic view illustrating a rear portion of the baby crib 100 according to a variant embodiment. Like previously described, the support frame 102 can include a base 108 (such as shown in FIG. 1). In this embodiment, two parallel upright segments 128 and parallel guide rails 130 are provided. The upright segments 128 can have lower ends connected with the base 108, and top ends respectively connected with the guide rails 130. The guide rails 130 and the base 108 can extend sideways to a same side of the upright segments 128 to provide stable support. The bassinet 104 can have a bottom that is movably connected with the guide rails 130. A latch 110 can also be provided at one end of each guide rail 130. The latches 110 can be operable to lock the bassinet 104 so that it cannot be adjustably moved relative to the guide rails 130. When the latches 110 are unlocked, the bassinet 104 can slide relative to the guide rails 130 to adjust a horizontal distance between the bassinet 104 and the caregiver.

Figure 5:
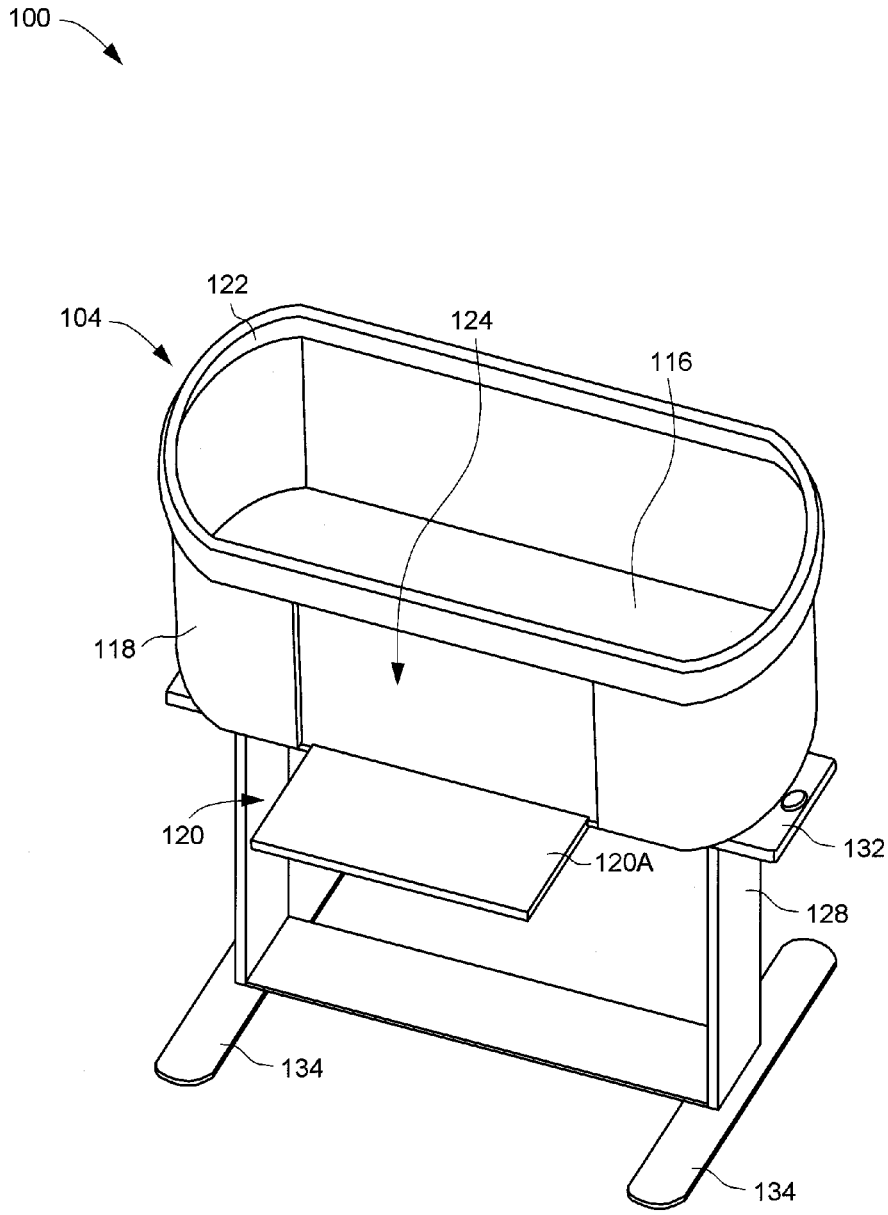
FIG. 5 is a perspective view illustrating another variant embodiment of the baby crib.

Many variations can be available for the construction of the support frame (as shown in FIG. 5) and the bassinet (as shown in FIGS. 6-13).

FIG. 5 is a perspective view illustrating another variant embodiment of the baby crib 100. The support frame 102 can include two parallel upright segments 128, two upper fixture elements 132, and two fixed bases 134. The upright segments 128 can have upper ends respectively secured with the upper fixture elements 132, and lower ends affixed with the bases 134. The bassinet 104 can be fixedly assembled with the upper fixture elements 132. A difference between the embodiment shown in FIG. 4 and that of FIG. 1 is that no wheels are provided in the embodiment of FIG. 4, and the baby crib 100 is used at a fixed position.

Figure 6:
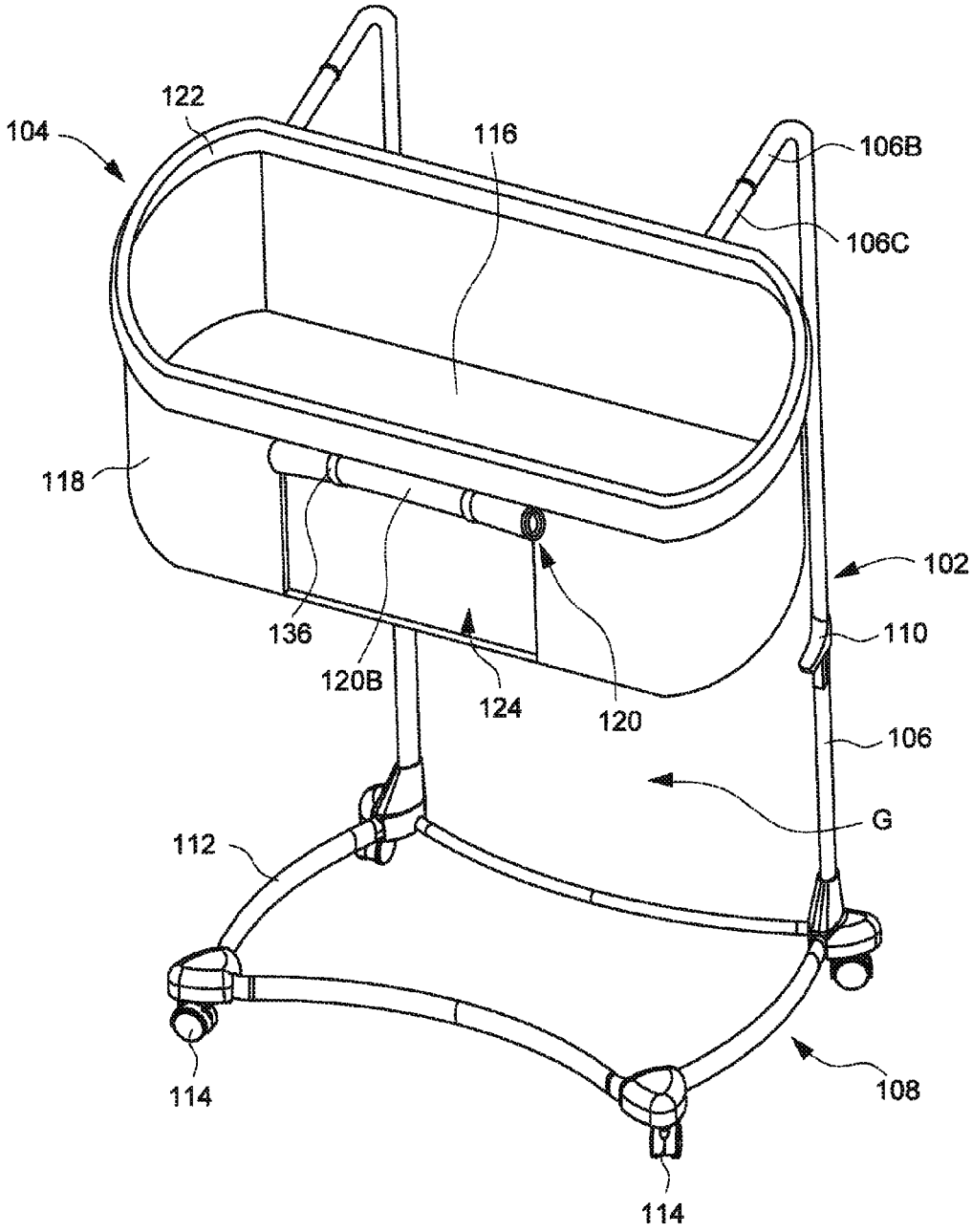
FIG. 6 is a schematic view illustrating a second embodiment of the bassinet 104 that differs from the previous ones by the construction of the cover element.

FIG. 6 is a schematic view illustrating a second embodiment of the bassinet 104 that differs from the previous ones by the construction of the cover element 120. In this embodiment, the cover element 120 can be constructed as a curtain 120B made of a flexible or soft material (such as fabric) that may be rolled up and unrolled as desired. The curtain 120B can be assembled at the location of the side opening 124, and have an upper end connected with the hand rest rail 122. The curtain 120B can be rolled up toward the hand rest rail 122, and then held in the rolled state via a fastener element 136 (for example a tie cord) to uncover the side opening 124. The curtain 120B can be unrolled to extend downward for covering and closing the side opening 124.

Figure 7:
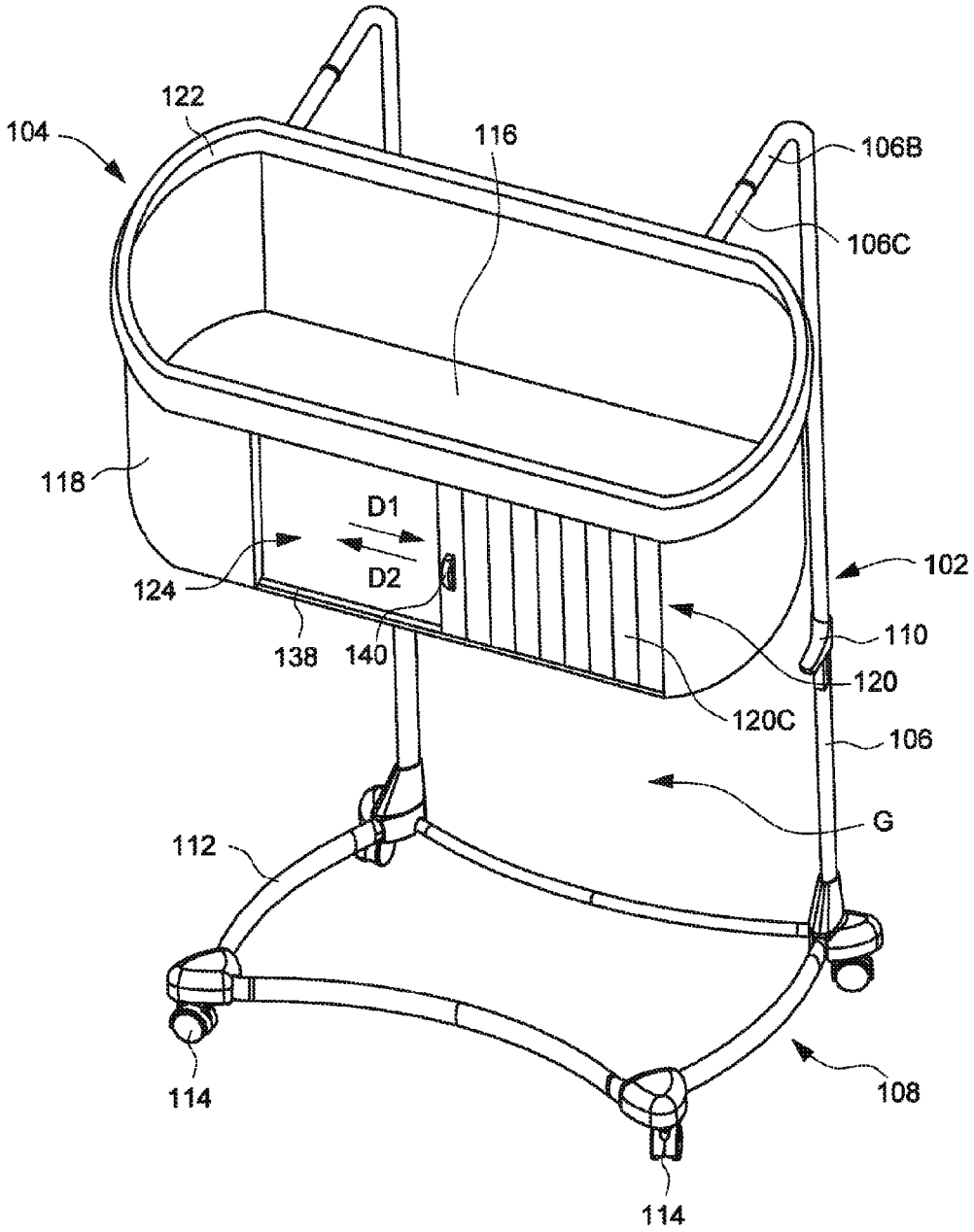
FIG. 7 is a schematic view illustrating a third embodiment of the bassinet.

FIG. 7 is a schematic view illustrating a third embodiment of the bassinet 104. The cover element 120 can be constructed as a movable door 120C that have upper and lower edges respectively connected with guide rails 138. A grip handle 140 may also be provided to facilitate operation of the movable door 120C. The movable door 120C can slide along the guide rails 138 in a direction D1 to uncover the side opening 124, or in a direction D2 to close and cover the side opening 124.

Figure 8:
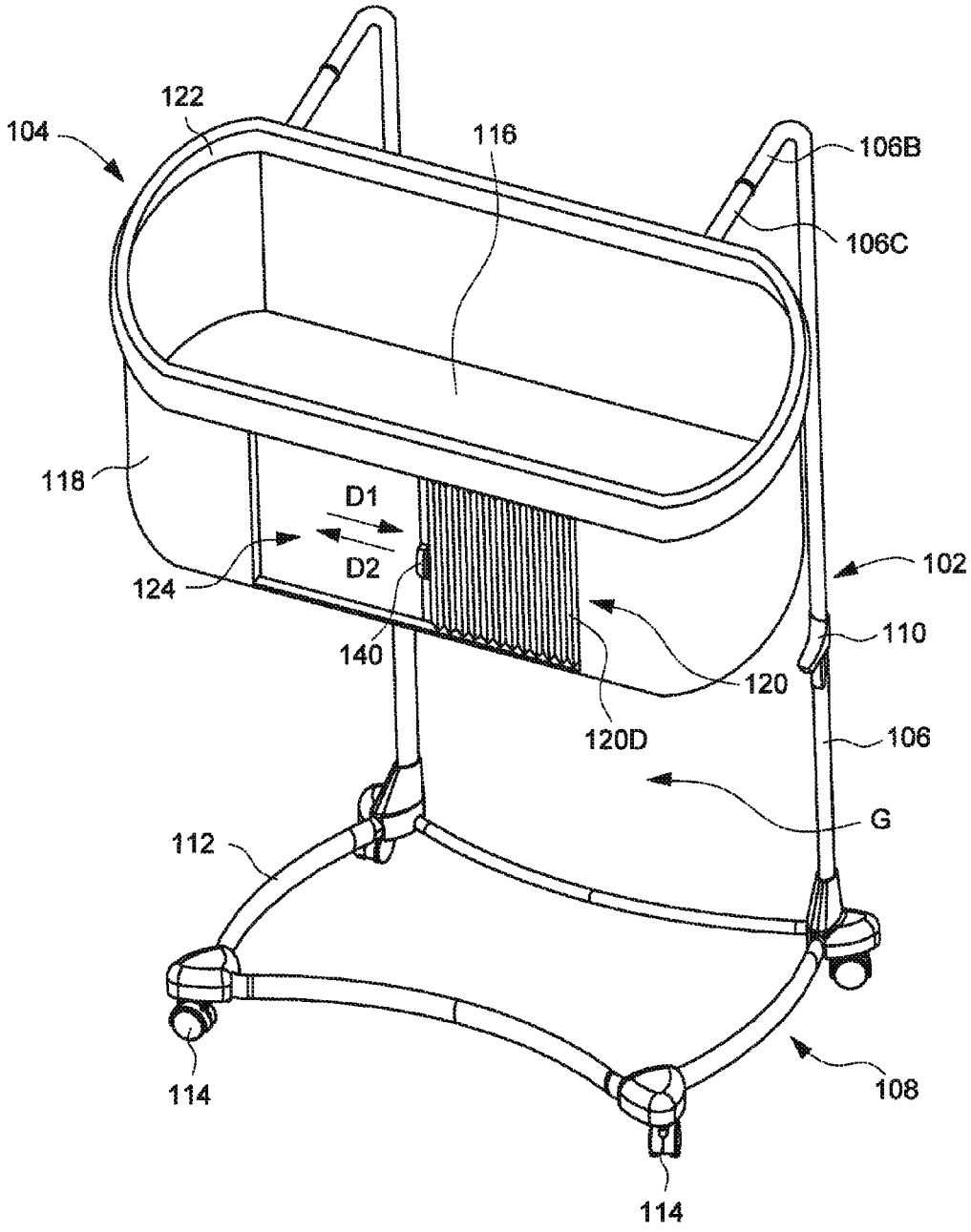
FIG. 8 is a schematic view illustrating a fourth embodiment of the bassinet.

FIG. 8 is a schematic view illustrating a fourth embodiment of the bassinet 104. The cover element 120 can be constructed as a collapsible door 120D that is made of a flexible and deformable material that can be deployed and collapsed as the door 120D is moved in either direction. The grip handle 140 can be likewise provided to facilitate operation of the door 120D. The collapsible door 120D can slide along the guide rails 138 in the direction D1 to fold and collapse the flexible material for uncovering the side opening 124, or in the direction D2 to unfold and deploy the flexible material to close and cover the side opening 124.

Figure 9:
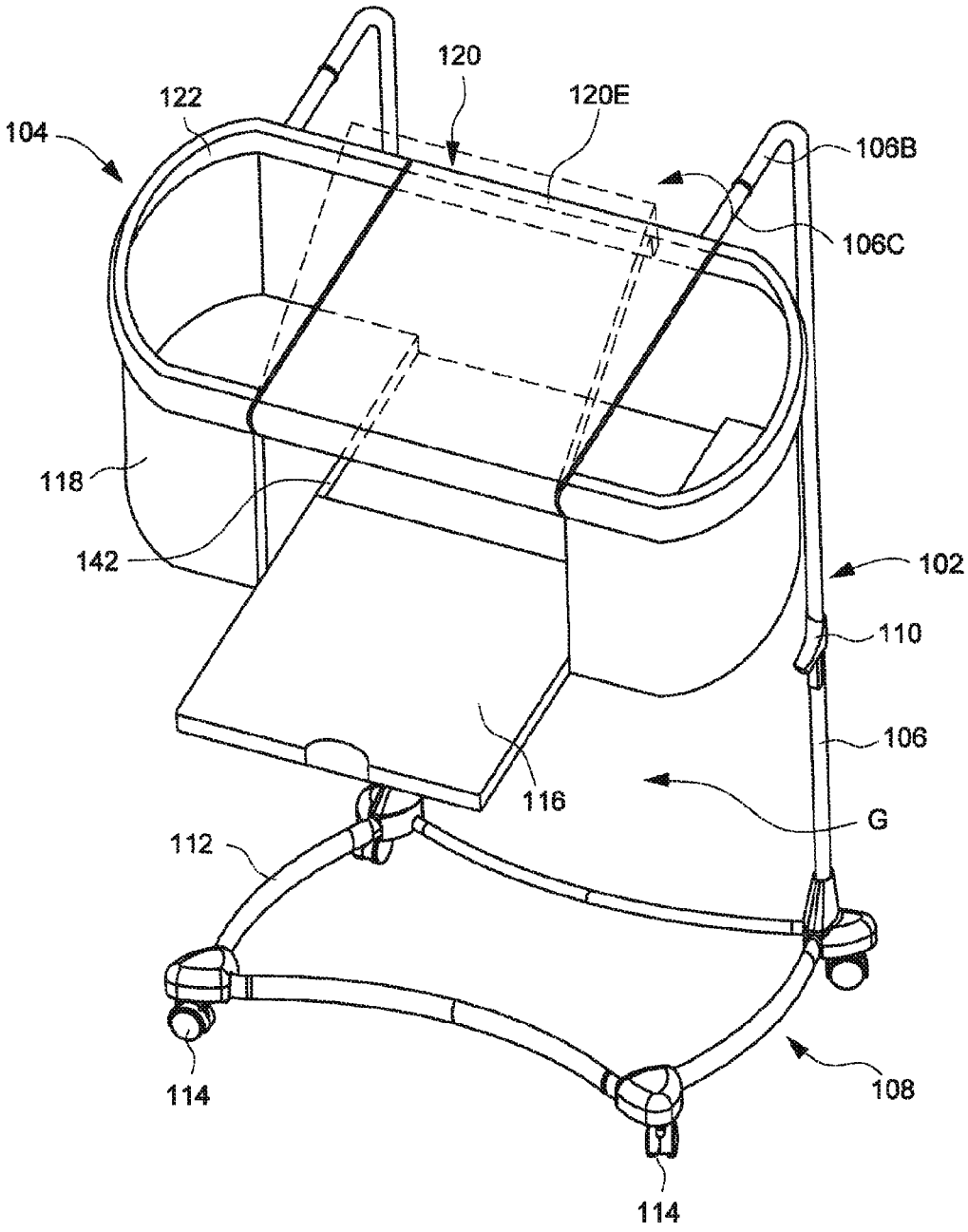
FIG. 9 is a schematic view illustrating a fifth embodiment of the bassinet.

FIG. 9 is a schematic view illustrating a fifth embodiment of the bassinet 104. The cover element 120 can be constructed as a rotary flap 120E that may be pivotally connected with the hand rest rail 122. The rotary flap 120E can turn upward to uncover the side opening 124, or turn downward to close and cover the side opening 124. In addition, two opposite side edges of the bottom board 116 can also be movably assembled with guide rails 142, such that the bottom board 116 may slide along the guide rails 142 to extend outward through the side opening 124 after the cover element 120 is opened.

Figure 10:
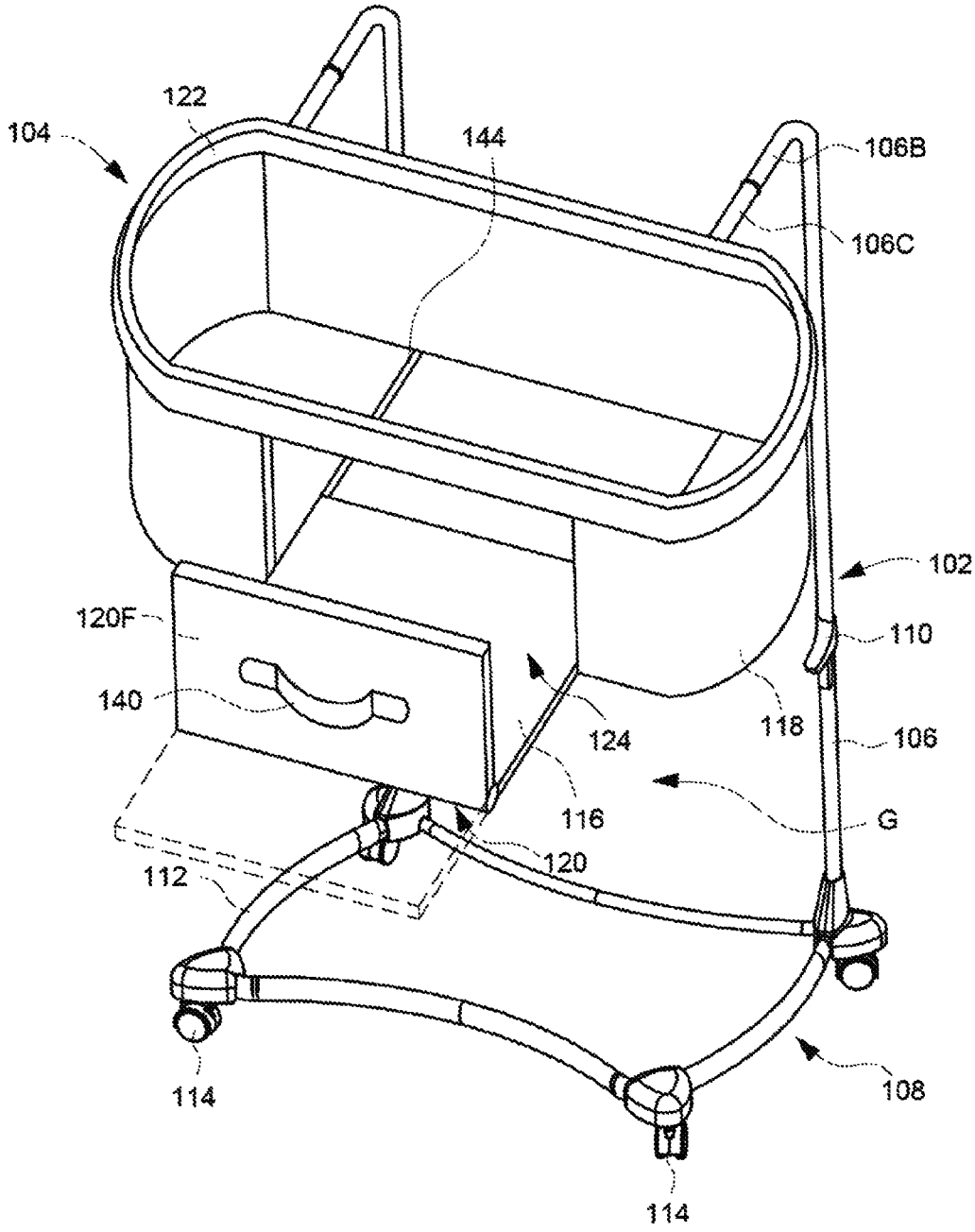
FIG. 10 is a schematic view illustrating a sixth embodiment of the bassinet.

FIG. 10 is a schematic view illustrating a sixth embodiment of the bassinet 104. The cover element 120 can be constructed as rotary flap 120F pivotally connected with the bottom board 116. Two opposite side edges of the bottom board 116 can be movably assembled with guide rails 144, such that the bottom board 116 and the rotary flap 120F may slide in unison along the guide rails 142 to extend outward or retract inward. A grip handle 140 may also be provided on an outer side of the rotary flap 120F to facilitate operation of the bottom board 116 and the rotary flap 120F. When the bottom board 116 is retracted inside the bassinet 104, the rotary flap 120F can be turned to a position erected upward from the bottom board 116 so as to close and cover the side opening 124. The rotary flap 120F can be turned downward relative to the bottom board 116 to uncover the side opening 124. If needed, the caregiver can also pull out the bottom board 116 and rotary flap 120F, and then turn downward the rotary flap 120F such that the bottom board 116 and the rotary flap 120F lie substantially on a same approximately horizontal plane.

Figure 11:
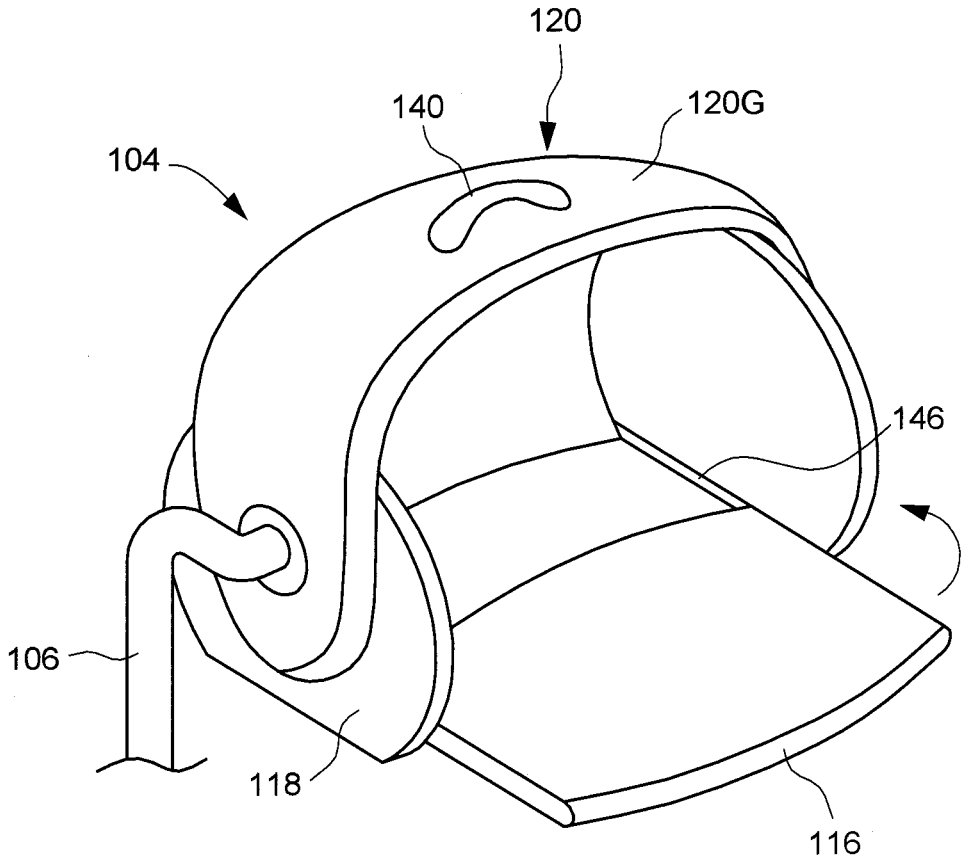
FIG. 11 is a schematic view illustrating a seventh embodiment of the bassinet.

FIG. 11 is a schematic view illustrating a seventh embodiment of the bassinet 104. The cover element 120 can be constructed as a shutter door 120G that is pivotally connected with an outer side of the enclosure 118. The shutter door 120G can be provided with the grip handle 140 to facilitate its operation. Two opposite side edges of the bottom board 116 can be movably assembled with guide rails 146. The shutter door 120G can rotate upward relative to the enclosure to uncover the side opening 124, or rotate downward to close and cover the side opening 124. When the side opening 124 is uncovered, the bottom board 116 can also slide along the guide rails 146 to extend outward through the side opening 124.

Figure 12:
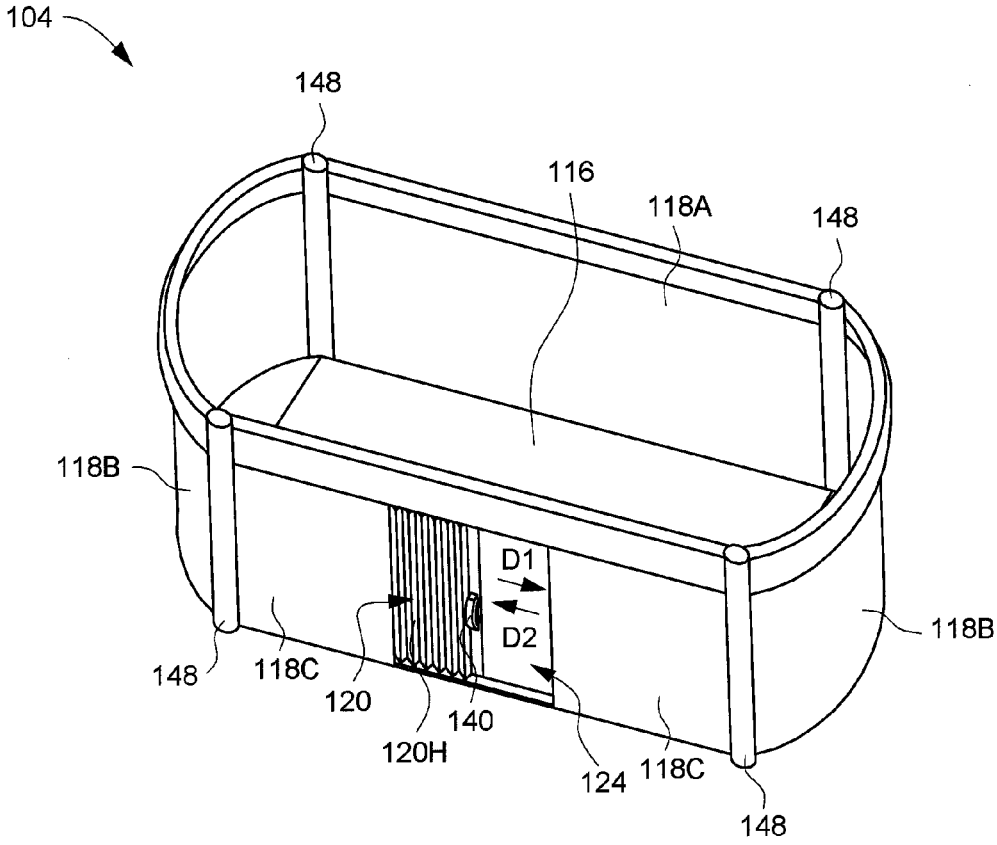
FIG. 12 is a schematic view illustrating an eighth embodiment of the bassinet.
Figure 13:
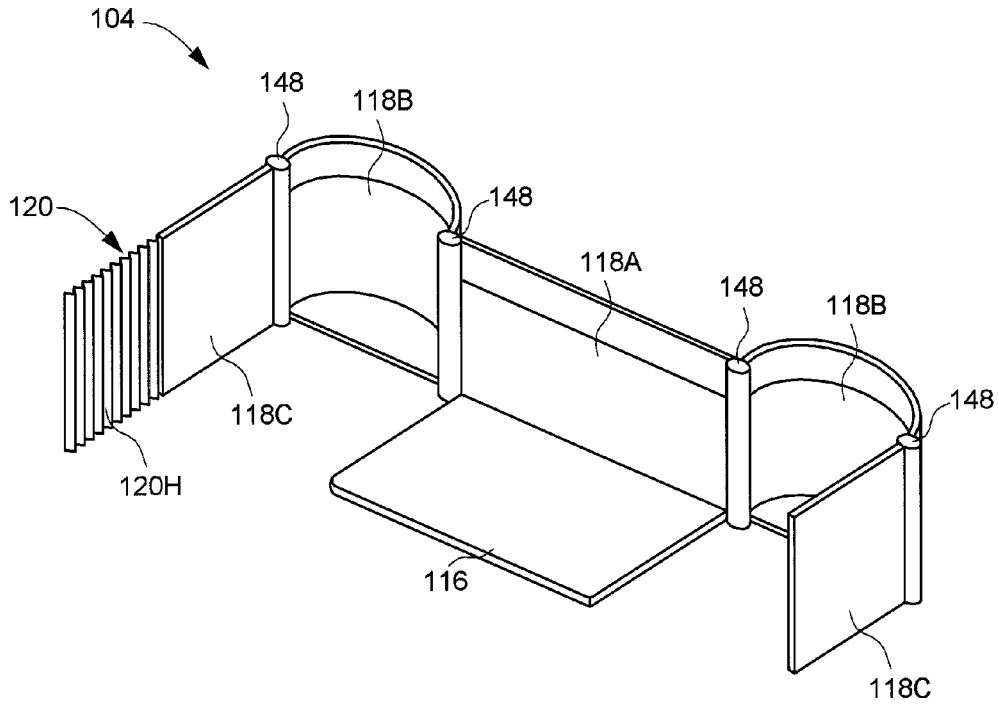
FIG. 13 is a schematic illustrating a configuration of use of the embodiment shown in FIG. 12.

FIG. 12 is a schematic view illustrating an eighth embodiment of the bassinet 104, whereas FIG. 13 is a schematic illustrating a configuration of use of the embodiment shown in FIG. 12. In this embodiment, the cover element 120 can be constructed as a collapsible door 120H that is operable to fold and unfold similar to the embodiment shown in FIG. 8. The enclosure 118 can be formed from a plurality of sidewalls, such as a first sidewall 118A, two second sidewalls 118B, and two third sidewalls 118C. The collapsible door 120H can be connected with one of the third sidewalls 118C. The first sidewall 118A can have a lower end affixed with a rear edge portion of the bottom board 116. The second sidewalls 118B can have first side edges respectively connected with two opposite side edges of the first sidewall 118A via hinges 148, and opposite second side edges respectively connected with the third sidewalls 118C via other hinges 148. As shown in FIG. 12, the enclosure 118 can be configured to substantially surround the bottom board 116 to substantially define the inner space of the bassinet 104. In this configuration, the side opening 124 can be defined as the gap formed between two opposing side edges of the third sidewalls 118C. The door 120H can slide in the direction D1 to unfold and deploy its flexible material for closing and covering the side opening 124, or in the direction D2 to fold and collapse its flexible material for uncovering the side opening 124.

As shown in FIG. 13, the second sidewalls 118B and third sidewalls 118C can also be rotated about their respective hinges 148 to open the enclosure 118 such that multiple sides of the bottom board 116 can be exposed outward.

At least one advantage of the structures described herein is the ability to provide a baby crib that has a side opening through which the caregiver can have access to the inner space of the bassinet. The side opening can be desirably closed or opened via a cover element. Accordingly, the baby crib can also be used as a bedside baby crib that allows the caregiver to sleep with the baby in a safe manner and provide care conveniently.

Realizations in accordance with the present invention therefore have been described only in the context of particular embodiments. These embodiments are meant to be illustrative and not limiting. Many variations, modifications, additions, and improvements are possible. Accordingly, plural instances may be provided for components described herein as a single instance. Structures and functionality presented as discrete components in the exemplary configurations may be implemented as a combined structure or component. These and other variations, modifications, additions, and improvements may fall within the scope of the invention as defined in the claims that follow.

What is claimed is:

1. A baby crib comprising:

an upright segment having a lower portion and an upper portion;

a base assembled with the lower portion of the upright segment for providing resting support on a ground surface; and a bassinet connected with the upper portion of the upright segment, wherein the bassinet includes:

an enclosure substantially surrounding an inner space of the bassinet adapted to receive a baby, the enclosure having a sidewall provided with a side opening communicating with the inner space; and a movable board disposed at a bottom of the bassinet and adapted to support the weight of the baby placed thereon, the board being operable to slide horizontally through the side opening between a first position where the board lies inside the inner space, and a second position where the board extends through the side opening and lies substantially outside the inner space; and a cover element operable to close and open the side opening, the cover element including a rotary flap pivotally assembled with the board.

2. The baby crib according to claim 1, wherein the base includes the assembly of multiple tube elements that form a substantially rectangular shape, and a plurality of wheels.

3. The baby crib according to claim 1, wherein the bassinet is vertically spaced apart from the base via a gap, the gap being delimited upwardly by the bassinet, downwardly by the base, and sideways by the upright segment.

4. The baby crib according to claim 1, wherein the bottom of the bassinet includes two guide rails, and the board has two opposite side edges assembled with the guide rails, the board being operable to slide along the guide rails.

5. A baby crib comprising:

a support frame having a lower portion and an upper portion; and a bassinet connected with the upper portion of the support frame, wherein the bassinet includes:

an enclosure substantially surrounding an inner space of the bassinet adapted to receive a baby, the enclosure being upwardly opened and having a sidewall provided with a side opening that is upwardly delimited by a portion of the enclosure and communicates with the inner space;

a movable board disposed at a bottom of the bassinet and adapted to support the weight of the baby placed thereon, the board being operable to slide through the side opening between a first position where the board lies inside the inner space, and a second position where the board extends outward through the side opening so that the board lies substantially outside the inner space; and a cover element operable to close and open the side opening, the cover element being pivotally assembled with the board, and the cover element moving in unison with the board when the board slides through the side opening.

6. The baby crib according to claim 5, wherein the lower portion of the support frame includes a base formed from the assembly of multiple tube elements and mounted with a plurality of wheels.

7. The baby crib according to claim 5, wherein the bottom of the bassinet includes two guide rails, and the board has two opposite side edges assembled with the guide rails, the board being operable to slide horizontally along the guide rails.

8. The baby crib according to claim 1, wherein the board and the rotary flap are movable in unison to extend outward or react toward the inner space of the bassinet.

9. The baby crib according to claim 1, wherein the rotary flap is operable to rotate relative to the board to a position erected upward from the board so as to close and cover the side opening when the board is retracted inside the bassinet.

10. The baby crib according to claim 9, wherein the rotary flap is further operable to turn downward such that the board and the rotary flap lie substantially on the same horizontal plane.

11. The baby crib according to claim 1, wherein an outer side surface of the rotary flap includes a grip handle.

12. The baby crib according to claim 5, wherein the cover element includes a rotary flap.

13. The baby crib according to claim 12, wherein the rotary flap is operable to rotate relative to the board to a position erected upward from the board so as to close and cover the side opening when the board is retracted inside the bassinet.

14. The baby crib according to claim 13, wherein the rotary flap is further operable to turn down such that the board and the rotary flap lie substantially on a same horizontal plane.

15. The baby crib according to claim 12, wherein an outer side surface of the rotary flap includes a grip handle.

* * * * *